US007874454B2

(12) United States Patent
Taylor

(10) Patent No.: US 7,874,454 B2
(45) **Date of Patent: *Jan. 25, 2011**

(54) UNIVERSAL LID FOR LARGE SOLID WASTE CONTAINERS

(76) Inventor: Craig V. Taylor, 22502 S. Summit Ridge Cir., Chatsworth, CA (US) 91311

( * ) Notice: Subject to any disclaimer, the term of this patent is extended or adjusted under 35 U.S.C. 154(b) by 141 days.

This patent is subject to a terminal disclaimer.

(21) Appl. No.: 12/193,611

(22) Filed: Aug. 18, 2008

(65) Prior Publication Data

US 2009/0045209 A1 Feb. 19, 2009

Related U.S. Application Data

(63) Continuation of application No. 11/289,180, filed on Nov. 29, 2005, now Pat. No. 7,413,100, which is a continuation of application No. 10/143,295, filed on May 10, 2002, now Pat. No. 6,968,972.

(51) Int. Cl.
*B65D 43/16* (2006.01)

(52) U.S. Cl. ..... 220/844; 220/908; 220/380; 220/781; 206/515; 206/505

(58) Field of Classification Search ..... 220/844, 220/380, 781, 782, 908; 206/515, 505, 508
See application file for complete search history.

(56) References Cited

U.S. PATENT DOCUMENTS

| | | | | |
|---|---|---|---|---|
| 4,335,828 | A | 6/1982 | Robinson et al. | |
| 4,342,402 | A * | 8/1982 | Jungles | 220/848 |
| 4,445,623 | A * | 5/1984 | Kolling et al. | 220/844 |
| 4,650,089 | A * | 3/1987 | Sanders | 220/848 |
| 4,771,940 | A * | 9/1988 | Taylor | 220/832 |
| 4,949,866 | A * | 8/1990 | Sanders | 220/810 |
| 5,088,616 | A * | 2/1992 | Susko et al. | 220/844 |
| 5,423,448 | A * | 6/1995 | Pedigo | 294/68.2 |
| 5,447,251 | A | 9/1995 | Taylor | |
| 5,564,586 | A * | 10/1996 | Goodwin | 220/844 |
| 5,868,267 | A * | 2/1999 | Taylor | 220/826 |
| 5,975,345 | A * | 11/1999 | Taylor | 220/826 |
| 6,758,366 | B2 | 7/2004 | Bourgund et al. | |
| 6,968,972 | B2 | 11/2005 | Taylor | |
| 7,413,100 | B2 * | 8/2008 | Taylor | 220/844 |
| 2001/0017302 | A1 * | 8/2001 | Bourgund et al. | 220/836 |
| 2003/0146230 | A1 * | 8/2003 | Eaton et al. | 220/826 |
| 2004/0178196 | A1 * | 9/2004 | Sholinder | 220/4.33 |
| 2005/0224507 | A1 * | 10/2005 | Gavin et al. | 220/836 |

* cited by examiner

*Primary Examiner*—Anthony Stashick
*Assistant Examiner*—Christopher B McKinley
(74) *Attorney, Agent, or Firm*—Fulwider Patton LLP

(57) ABSTRACT

A universal lid for industrial or commercial large size solid waste containers, has a ribbed single layer central portion and a peripheral edge having a hollow double wall boxed configuration. The boxed perimeter may have a predetermined height such as approximately one inch, and the lid is provided with hinge lugs having a vertical extent substantially more but not more than twice than said predetermined height. In addition, the lids have substantial symmetry so that the lids may be stacked and nested with alternate lids oriented in opposite front-to-back directions. With this type of lid, the advantages of both single layer and double layer lid constructions may be realized.

4 Claims, 3 Drawing Sheets

UNIVERSAL LID FOR LARGE SOLID WASTE CONTAINERS

RELATED APPLICATIONS

This application is a continuation of U.S. application Ser. No. 11/289,180, filed Nov. 29, 2005, now U.S. Pat. No. 7,413,100, which is a continuation of U.S. application Ser. No. 10/143,295, filed May 10, 2002, now U.S. Pat. No. 6,968,972 Applicant claims priority to all of the applications in the chain. This related application is herein incorporated by reference in its entirety.

BACKGROUND OF THE INVENTION

For more than 25 years, there have been two basic types of plastic lids for large commercial and industrial (1 cubic yd.-16 cubic yd.) solid waste containers. They have been either, a single sheet of plastic formed with various rib configurations, or a hollow double wall fabrication with an even greater variety of ribbing combined with partial fusion of the top and bottom walls. Each type has significant advantages as well as known drawbacks.

Single Wall Lid Advantages

Both types of lids are limited to a maximum weight of approximately 15 pounds for lifting ease. Therefore, the double wall type has approximately half the wall thickness of its single wall counterpart. In the highly abusive environment of the solid waste industry, the thicker single wall lids last longer due to the simple fact that it is inherently more cut, puncture and abrasion resistant. The thicker wall also resists UV degradation far longer. Double wall lids will also allow the ingress of rainwater when punctured. This may result in an unwanted shower for the user when the lid is rotated open or closed. In winter conditions when the water is frozen to ice, the lids can become too heavy for the user to lift. Single wall lids do not retain water except in the open horizontal position and are easily emptied in a controlled fashion.

For any given rib height, the single wall additional thickness increases the load bearing of the rib by the cube of the increase in the thickness (i.e. if you double the thickness of the rib wall, the stiffness is increased 8 times). Load bearing is important for safety; primarily with regard to children playing on top of a container. Additionally, load bearing is required to resist collapse of the lid into the container due to excessive snow loads or trash bags piled on top of the lids.

The delivery and storage costs of single wall lids are nearly half the cost of double wall lids. Single wall lids rest one on the other every vertical one-half inch. The typical double wall lid has a vertical nesting depth of nearly two inches per lid. A full truckload of double wall lids weights about 23,000 lbs. (1560 lids) whereas a full truckload of single wall lids weighs about 40,000 lbs. (2700 lids). The same issues affect the amount of storage space required throughout the distribution process.

Double Wall Lid Advantages

The double wall lid is superior to the single wall lid with regard to usability, i.e., the person opening the lid to deposit trash prefer the double wall type because it will not twist laterally when lifted off center as is the case with single wall lids. Standing to one side and lifting off center is necessary when depositing larger articles or trash bags as the typical lid in a pair will only provide an opening which is 30 inches to 36 inches wide.

This lateral twisting is a problem for the user because the side of the lid opposite that which is raised with one hand will not lift to the same height as the other (typically 12 or more inches lower) and will effectively block the deposit of trash with the users other hand. This is not a mere annoyance, because in most cases and especially on larger containers, the user will throw open the lid over the back of the container and leave it in the open position due to the difficulty of retrieving the lid and closing it. In communities where they are used, it is not uncommon to find the majority of large waste containers with the lids left open. This condition is obviously unsightly and creates a real health and litter problem in any community.

The double wall lid has significantly stronger hinge lugs than single wall lid fabrications. This is especially true of rotationally molded double wall lids. Most single wall fabricating techniques stretch the material thinner in all raised areas such as ribs and hinge lugs. Furthermore, the hole for the hinge rod is drilled through the thinner stretched wall. This 9/16 inches to 11/16 inches diameter hole is by necessity ½ inch to ⅝ inches from the edge of the plastic fabricated sheet. When stressed, the ½ inch diameter hinge rod can pull through the edge with relative ease.

The double wall hinge hole for the lid pivot shaft extends through the side of a boxed hinge lug that has no nearby edge to pull through. This type of fabrication requires the hinge rod to be pulled through the entire side and back wall of the boxed lug in order to fail. Even with double wall fabrications that stretch the wall material thinner as in typical single wall fabrication, the double wall boxed lug is far stronger and will hold the lid on the container far longer than is the case for single wall lids.

SUMMARY OF THE INVENTION

The new lid design effectively combines the best features and eliminates the worst of both basic lid types on the market today, the single wall thermoform, rotomolded or compression molded lid and the double wall rotomolded, blow molded or twin sheet thermoformed lid.

The new design is 90% single wall construction except for the perimeter and the hinge lug area. The perimeter has a hollow double wall substantially closed cross-section, preferably boxed-like or rectangular in cross-section. The hinge lug area is preferably also a double wall fabrication with each hinge lug having a full molded, steel sleeved tube running the full width of each lug. The hollow substantially closed perimeter edge dramatically reduces the typical single wall lateral deflection. There are preferably a plurality full hinge lugs adjacent to one another at each rear corner. This increases the tear out resistance to a greater level than the typical single corner hinge lug of the typical double wall lid.

The vertical nesting depth of the new lid may be one inch, the thickness of the boxed perimeter of the lids, even though the hinge lug may be a full one and three quarters inches in thickness, in a specific illustrative embodiment. The significance of this is simple. A one inch nesting depth allows the lid to ship 2700 pieces at 40,000 lbs. per truckload. This is equal to the shipping efficiency of the typical single wall lid without sacrificing hinge lug strength. The hinge lug is the same as its double wall rotationally molded counterpart. This combination of features is accomplished with a unique alternate nesting design. This design allows each lid to be positioned on top of the other fully nested to the one perimeter edge thickness with each successive lid juxtaposed lengthwise in the opposite direction from the lid underneath. In this method of stacking the thicker hinge lugs project beyond the front edge of the lid underneath and on top; essentially a one and three quarter inch lug in a two inch space, yet the overall height of a stack of e.g., 50 lids is only 50 inches not 50×1¾=87½ inches, plus the height of the ribs of one lid, of course.

Accordingly, the total height of a stack of lids is equal to the number of lids multiplied times the height of the boxed edges, plus the height of the ribs of one lid, above its hollow closed edge.

In accordance with a broader aspect of the invention, a lid for commercial or industrial solid waste containers comprises a central ribbed area of the lid formed of a single layer of plastic and a perimeter with a hollow substantially closed cross-sectional configuration, having a predetermined thickness. The hinge lug area has a double wall construction and is substantially thicker, but is equal to or less than twice as thick as the predetermined thickness of the perimeter hollow edges. In addition the lids are substantially symmetrical so that they may be stacked with each lid reversed in its front-to-rear orientation, relative to the adjacent lids, and with the front of the lid being shaped to provide clearance for the "over-size" hinge lugs.

Other objects, features and advantages of the invention will become apparent from a consideration of the following detailed description and from the accompanying drawings.

DETAILED DESCRIPTION OF THE PREFERRED EMBODIMENTS OF THE INVENTION

While the specification describes particular embodiments of the present invention, those of ordinary skill can devise variations of the present invention without departing from the inventive concepts.

Figure 1:
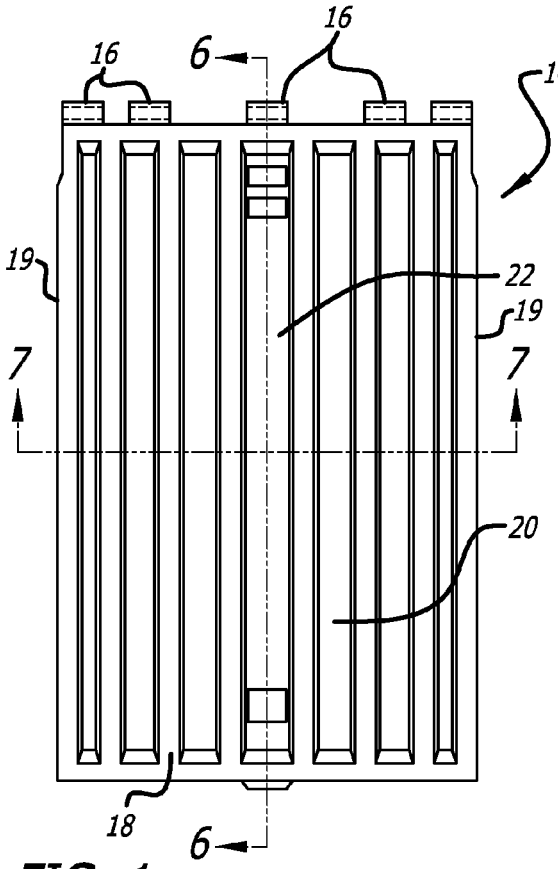
FIG. 1 is a top view of a universal lid for industrial and commercial solid waste containers, illustrating the principles of the invention.
Figure 3:
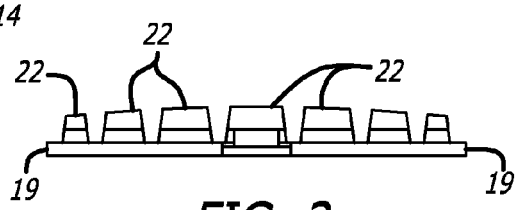
FIG. 3 is an end view from the front of the lid.
Figure 2:
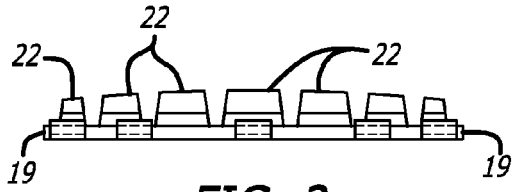
FIG. 2 is an end view of the lid of FIG. 1 taken from the rear and showing the hinge lug components.

Referring now to FIG. 1 of the drawings, the lid 14 has a rear edge with a plurality of hinge lugs 16, thereon. The front edge 18 of the lid 14 is shaped to provide clearance for the hinge lugs 16, discussed in greater detail hereinbelow. The lid 14 includes the two sides 19, which have a hollow boxed cross-sectional configuration, as will be discussed in greater detail elsewhere in the specification. In addition, the central portion 20 of the lid 14 is a single, fairly thick layer of plastic, preferably about 3/16 inch thick, and preferably made of polyethylene, although other plastic materials may be employed. As shown to advantage in the end views of FIGS. 2 and 3 of the drawings, the central portion of the lid has a series of ribs 22 which increase the stiffness or rigidity of the overall lid 14.

Figure 4:
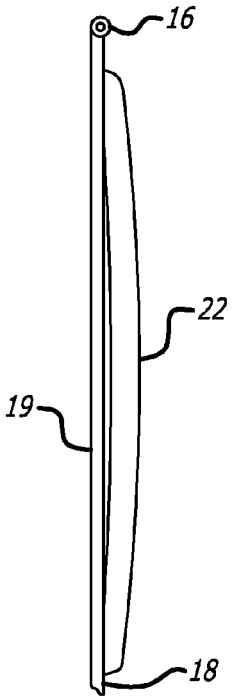
FIG. 4 is a side view of the lid of FIG. 1.

The side view of FIG. 4 shows the enlarged hinge lugs 16 to advantage, as well as the front edge 18 and the ribs 22.

Figure 5:
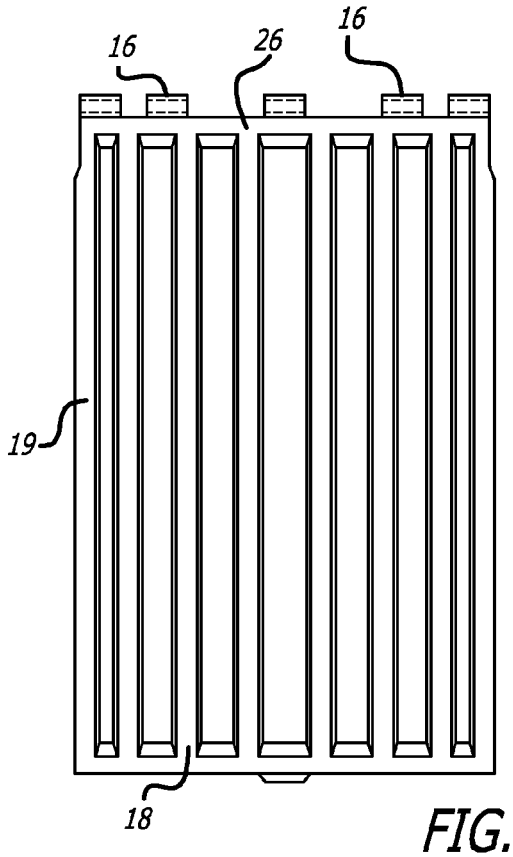
FIG. 5 is a bottom view of the universal lid shown in FIG. 1.

FIG. 5 is a bottom view of the lid of FIG. 1, with the various features discussed above in connection with FIGS. 1-4 being clearly shown in FIG. 5, and carrying the same reference numerals. It is again noted that the boxed cross-sectional configuration is preferably employed around the full perimeter of the lid, with reference numeral 19 extending to the boxed perimeter on the two sides, and the front edge 18 having the hollow boxed configuration and also a shape to provide clearance for the enlarged hinge lugs 16, upon stacking. Between the lugs 16, the rear edge of the lid 14 includes the boxed cross-sectional configuration 26 from which the hinge lugs 16 extend.

Figure 6:
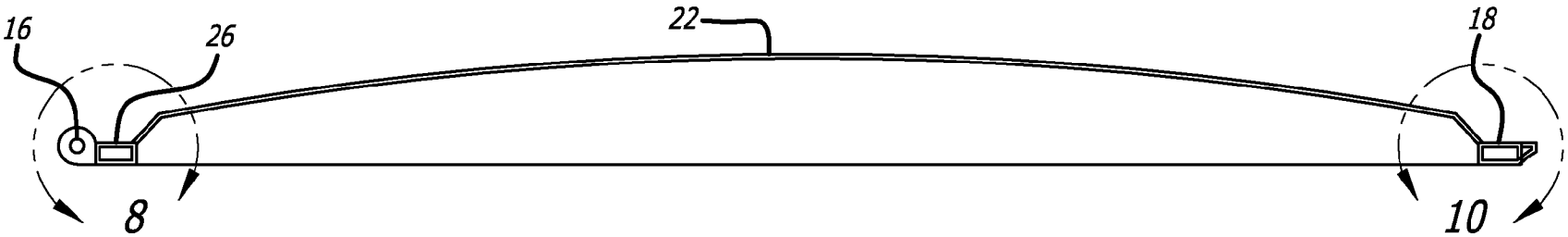
FIG. 6 is a sectional view taken along lines 6-6 of FIG. 1.

FIG. 6 is a longitudinal cross-sectional view of the lid of FIG. 1 taking along line 6-6 thereof. Clearly visible in FIG. 6 are the enlarged hinge lugs 16 and the associated boxed configuration perimeter 26 at the rear edge of the lid, and the shaped front edge 18 of the lid. In addition, one of the ribs 22, formed of a single thickness of plastic, is shown in FIG. 6. It may also be noted, relative to the rib 22, that it is substantially symmetrical front-to-rear, so that when the lids are stacked with alternate lids reversed in front-to-back orientation, to be discussed below, there is no interference between the ribs of successive lids.

Figure 7:
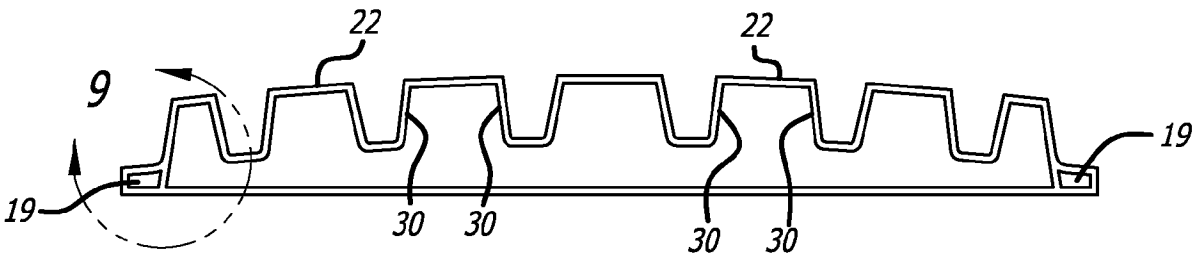
FIG. 7 is a cross-sectional view taken along line 7-7 of FIG. 1.

Referring now to FIG. 7 of the drawings, it is a cross-sectional view taken along line 7-7 of FIG. 1. The boxed configuration perimeter is shown at reference numeral 19 at each side of the lid as shown in FIG. 7, and the ribs 22 are also clearly apparent. It may be noted in passing that the ribs 22 and rib sidewalls 30 which are slanted in order to facilitate stacking, will be discussed in greater detail hereinbelow.

Figure 8:
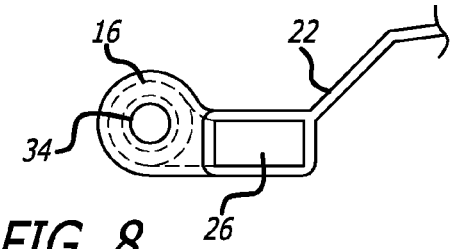
FIG. 8 is an enlarged cross-sectional view of the hinge lug edge of the lid of FIG. 1, taken as indicated at 8-8 of FIG. 6.

Referring now to FIG. 8 of the drawings, this is an enlarged partial cross-sectional view taken along line 8-8 of FIG. 6. The boxed configuration 26 is clearly shown in FIG. 8 as well as the enlarged hinge lugs 16. Incidentally, the hinge lugs 16 are provided with a central galvanized steel sleeved tube 34 which receives a pivot shaft for mounting the lid on a large industrial trash bin.

Figure 9:
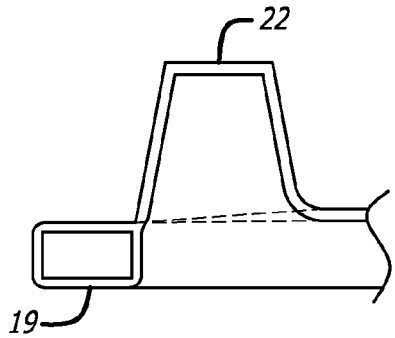
FIG. 9 is an enlarged cross-sectional view of the edge of the lid taken along lines 9-9 of FIG. 7.

FIG. 9 is an enlarged cross-sectional view of the side edges of the lid bearing the reference numeral 19, and clearly showing the boxed configuration extending around the lid. In addition, a rib 22 is shown, with the rib 22 being of single plastic wall construction, forming part of the central section 20 of the universal lid, which, as mentioned above, is substantially of a single wall configuration.

Figure 10:
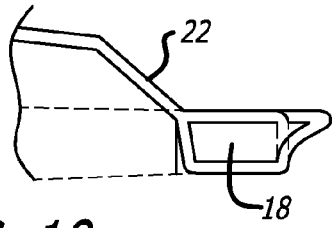
FIG. 10 is an enlarged partial cross-sectional view showing the front edge of the universal lid of FIG. 1, taken as indicated at 10-10 in FIG. 6.

FIG. 10 is an enlarged cross-sectional view of the front edge 18 of the lid, showing the beginning of a rib 22, and a special configuration 36 which fits closely over the hinge lugs 16, when the lids are nested, with alternate lids being faced in opposite directions.

Figure 11:
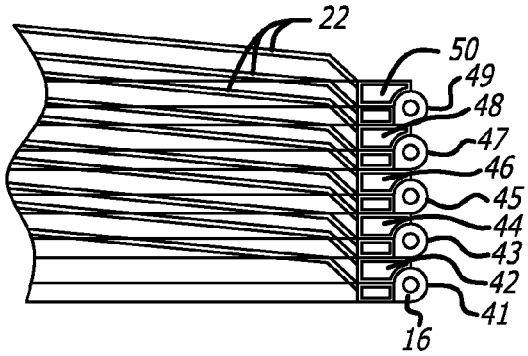
FIG. 11 is a showing of a stack of the lids shown in the prior figures of the drawings, with the lids being alternated in their orientation, front-to-back.

FIG. 11 is a side view of one end of a stack of lids, with alternate lids being oriented in opposite directions. Thus, the lids 41, 43, 45, 47 and 49 have the hinge lugs facing to the right as shown in FIG. 11, while the lids 42, 44, 46, 48 and 50 have their edges 18 oriented to the right in FIG. 5. The front edge of the even numbered lids, as included in FIG. 11, are curved to easily fit over the enlarged hinge lugs 16 of the lids, when the hinge lugs are facing to the right as shown in FIG. 11. It may also be noted that the ribs 22 are substantially symmetrical, so that they readily fit within one another, and within the one inch space provided by the boxed perimeter configuration of the lid.

Figure 12:
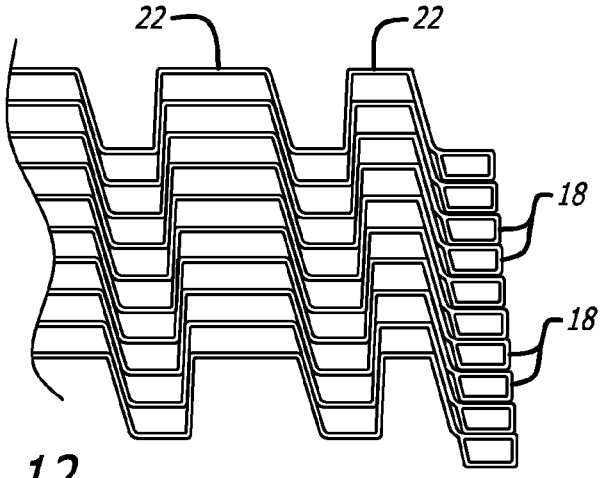
FIG. 12 is a partial cross-sectional view of a stack of lids showing the sides of the lids, and how the lids may be stacked together with minimal spacing between successive lids.

FIG. 12 is a side view of a stacked configuration of lids, with the edges 19 of all the lids resting upon one another, and providing the standard spacing between successive lids which may be one inch, for example. It may be noted that the lids 22 are also formed in a substantially symmetrical configuration, so that the alternate lids which are oriented in opposite directions longitudinally, readily fit together. Also, as mentioned above, the ribs 22 are provided with slanted walls, to facilitate inter fitting.

Concerning the type of solid waste container with which the present lids may be used, reference is made to issued U.S. Pat. No. 4,771,940 granted Sep. 20, 1988; and this patent is hereby incorporated by reference into this specification.

In the foregoing detailed description one illustrative embodiment of the invention has been described. It is to be understood, however, that various changes and modifications may be made without departing from the spirit and scope of the invention. In the disclosed embodiment, a lid having dimensions of 36 inches wide by 58 inches long is disclosed with ribs about 3.9 inches high from the base plane of the lid, and with a total of 7 ribs. However, by way of example and not of limitation, the shape and number of ribs may be modified as well as the overall size of the lid, to suit specific needs or containers. With regard to the shape of the lids, they should be substantially symmetrical, front-to-rear, and side-to-side, so that, when stacked with alternate lids being reversed in front-to-back orientation, the lids substantially rest on the boxed perimeter edges of the lids. With the boxed edges preferably being about one inch in height, however, and the central lid single walls being only 3/16 inch thick, some variation from symmetry in rib configuration, less than the one inch height of separation of the lids, is acceptable, and within the "substantially symmetrical" term. Concerning dimensions, it has been noted that the height of the boxed perimeter is preferably about one inch; however variations from about one-half inch to two inches may be employed depending on physical requirements and the size of the lid, for examples. Thus, it is to be understood that for smaller and larger lids the thickness of the boxed perimeter and the height of the ribs, and the thickness of the plastic may be decreased or increased, respectively. It is further noted that the hollow substantially closed perimeter edges may be circular, oval or have other geometric shapes, although a rectangular configuration is preferred. Also, there may be some short sections around the perimeter where the edge construction may not be fully closed. Accordingly, the present invention is not limited to the specific embodiment as shown in the drawings and described in detail hereinabove.

We claim:

1. A plastic lid for commercial and industrial solid waste containers, comprising:

a central area having a single wall construction;

a set of perimeter edges having a substantially closed configuration substantially surrounding the central area, the set of perimeter edges having a substantially hollow double wall cross-sectional configuration joined to the central area, the substantially hollow double wall cross-sectional configuration including a top wall and a bottom wall, the cross-sectional configuration having a predetermined vertical extent, at least one of the perimeter edges having a section that is not closed, said section that is not closed having a length less than the length of said at least one of the perimeter edges;

a plurality of hinge lugs disposed along a rear edge of the set of perimeter edges, the hinge lugs having a height greater than the predetermined vertical extent; and a front edge of the set of perimeter edges disposed to provide vertical clearance for the hinge lugs on the rear edge when the lid is stacked in alternating engagement with the edges of adjacent lids, the front edge including at least portion wherein the top wall and the bottom wall of the substantially hollow double wall cross-sectional configuration are pressed together.

2. The plastic lid of claim 1, wherein at least one of the plurality of hinge lugs is formed as an extension of an outer wall of the rear edge.

3. The plastic lid of claim 1, wherein a portion of the top wall of the rear edge is extended to form at least one of the plurality of hinge lugs.

4. The plastic lid of claim 1, wherein a portion of the top and bottom walls of the rear edge are extended to form at least one of the plurality of hinge lugs.

* * * * *